US009234659B2

(12) United States Patent
Babington

(10) Patent No.: US 9,234,659 B2
(45) **Date of Patent: *Jan. 12, 2016**

(54) PERFORATED FLAME TUBE FOR LIQUID FUEL BURNER

(71) Applicant: Robert S. Babington, McLean, VA (US)

(72) Inventor: Robert S. Babington, McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/096,374

(22) Filed: Dec. 4, 2013

(65) Prior Publication Data

US 2014/0093831 A1 Apr. 3, 2014

Related U.S. Application Data

(63) Continuation of application No. 12/173,902, filed on Jul. 16, 2008, now Pat. No. 8,622,737.

(51) Int. Cl.

| | |
|---|---|
| ***F23C 6/04*** | (2006.01) |
| ***F23D 11/12*** | (2006.01) |
| ***F23D 11/40*** | (2006.01) |
| ***F23D 11/44*** | (2006.01) |

(52) U.S. Cl.

CPC ..... *F23D 11/12* (2013.01); *F23C 6/045* (2013.01); *F23D 11/404* (2013.01); *F23D 11/44* (2013.01); *F23C 2900/06041* (2013.01); *F23D 2214/00* (2013.01)

(58) Field of Classification Search

CPC ..... F23R 3/08; F23R 3/06; F23D 14/58; F23D 11/404; F23D 11/107; F23D 14/20; F23C 9/08; F23C 6/045; F23C 2900/03003; F23C 2900/06041; F23C 2201/20; F23C 3/006

USPC ..... 431/8, 353, 352, 351, 10, 195–197, 431/201; 60/760.756

See application file for complete search history.

(56) References Cited

U.S. PATENT DOCUMENTS

| | | | | |
|---|---|---|---|---|
| 1,439,186 | A | 12/1922 | Mummery | |
| 1,650,342 | A * | 11/1927 | Good | 431/266 |
| 1,725,510 | A | 8/1929 | Fiske | |
| 2,221,519 | A | 11/1940 | Jones et al. | |
| 2,227,666 | A | 1/1941 | Noack | |

(Continued)

FOREIGN PATENT DOCUMENTS

| | | |
|---|---|---|
| DE | 36 18987 A1 | 12/1987 |
| EP | 93572 A1 | 11/1983 |

(Continued)

OTHER PUBLICATIONS

European Search Report dated Jul. 1 , 2014.

*Primary Examiner* — Avinash Savani
*Assistant Examiner* — Vivek Shirsat
(74) *Attorney, Agent, or Firm* — Novak Druce Connolly Bove + Quigg LLP

(57) ABSTRACT

A flame tube for a liquid fuel burner is disclosed. The liquid fuel burner includes a fuel atomizer directing atomized fuel into the flame tube and an igniter disposed within the flame tube to ignite the atomized fuel. The flame tube comprises an outer wall and an inner wall disposed about the outer wall to define an air passage therebetween. At a discharge end of the flame tube, the outer and inner walls are conjoined to form an annular surface, the annular surface being perforated. Preferably, the annular surface is perforated in an evenly distributed pattern.

13 Claims, 2 Drawing Sheets

(56) References Cited

U.S. PATENT DOCUMENTS

| | | | | | |
|---|---|---|---|---|---|
| 2,348,760 | A | | 5/1944 | Stamm | |
| 2,446,059 | A | | 7/1948 | Peterson et al. | |
| 2,469,272 | A | | 5/1949 | Logan | |
| 2,538,953 | A | | 1/1951 | Yates et al. | |
| 2,601,000 | A | | 6/1952 | Nerad | |
| 2,617,255 | A | | 11/1952 | Niehus | |
| 2,654,219 | A | | 10/1953 | Zaba | |
| 2,654,996 | A | | 10/1953 | Boninsegni | |
| 2,673,726 | A | | 3/1954 | Oldenkamp | |
| 2,692,014 | A | | 10/1954 | MacCracken | |
| 2,806,516 | A | | 9/1957 | Brola | |
| 2,901,032 | A | | 8/1959 | Brola | |
| 2,967,224 | A | | 1/1961 | Irwin | |
| 2,986,206 | A | | 5/1961 | Boelsma | |
| 3,030,773 | A | | 4/1962 | Johnson | |
| 3,245,457 | A | | 4/1966 | Smith et al. | |
| RE26,244 | E | | 8/1967 | Spielman | |
| 3,359,724 | A | | 12/1967 | Barnwell et al. | |
| 3,401,920 | A | | 9/1968 | Berkhoudt et al. | |
| 3,494,711 | A | | 2/1970 | Spielman | |
| 3,514,244 | A | | 5/1970 | Meyer et al. | |
| 3,603,711 | A | | 9/1971 | Downs | |
| RE27,321 | E | * | 3/1972 | Briggs | 431/352 |
| 3,694,135 | A | | 9/1972 | Dancy et al. | |
| 3,736,747 | A | | 6/1973 | Warren | |
| 3,859,786 | A | | 1/1975 | Azelborn et al. | |
| 4,007,001 | A | | 2/1977 | Schirmer et al. | |
| 4,082,495 | A | | 4/1978 | Lefebvre | |
| 4,104,017 | A | * | 8/1978 | Alin | 431/352 |
| 4,155,700 | A | | 5/1979 | Babington | |
| RE30,285 | E | | 5/1980 | Babington | |
| 4,298,338 | A | * | 11/1981 | Babington | 431/352 |
| 4,373,325 | A | | 2/1983 | Shekleton | |
| 4,424,793 | A | | 1/1984 | Cooperrider | |
| 4,431,403 | A | | 2/1984 | Nowak et al. | |
| 4,507,074 | A | | 3/1985 | Babington et al. | |
| 4,507,076 | A | | 3/1985 | Babington | |
| 4,516,928 | A | | 5/1985 | Babington | |
| 4,547,147 | A | | 10/1985 | Suzuki et al. | |
| 4,573,904 | A | | 3/1986 | Babington | |
| 4,586,894 | A | * | 5/1986 | Wunning | 431/158 |
| 4,708,637 | A | | 11/1987 | Dutescu | |
| 4,780,077 | A | | 10/1988 | Lefebvre | |
| 4,928,605 | A | | 5/1990 | Suwa et al. | |
| 5,055,032 | A | | 10/1991 | Altemark et al. | |
| 6,152,128 | A | | 11/2000 | Willey et al. | |
| 6,183,240 | B1 | | 2/2001 | Dobbeling et al. | |

FOREIGN PATENT DOCUMENTS

| | | | |
|---|---|---|---|
| EP | 300079 | A1 | 1/1989 |
| EP | 1030106 | A2 | 8/2000 |
| EP | 1278009 | A2 | 1/2003 |
| GB | 2035538 | A | 6/1980 |
| GB | 2176274 | A | 12/1986 |
| JP | 57108509 | A | 7/1982 |
| JP | 59200115 | A | 11/1984 |
| JP | 62293006 | A | 12/1987 |
| JP | 01102206 | A | 4/1989 |
| JP | 01269809 | A | 10/1989 |
| JP | 01302003 | A | 12/1989 |
| JP | 01305212 | A | 12/1989 |
| JP | 02008606 | A | 1/1990 |
| JP | 02247408 | A | 10/1990 |
| JP | 06257720 | A | 9/1994 |
| JP | 07239122 | A | 9/1995 |
| JP | 52017223 | A | 2/1997 |
| JP | 11257608 | A | 9/1999 |
| JP | 2001021114 | A | 1/2001 |
| JP | 03170707 | B2 | 5/2001 |
| JP | 03170708 | B2 | 5/2001 |
| JP | 2001304509 | A | 10/2001 |
| JP | 2003322311 | A | 11/2003 |
| JP | 2006349257 | A | 12/2006 |
| JP | 05248705 | B2 | 7/2013 |
| WO | WO-8002451 | A1 | 11/1980 |

* cited by examiner

PERFORATED FLAME TUBE FOR LIQUID FUEL BURNER

CROSS REFERENCE TO RELATED APPLICATIONS

The instant application is a continuation of U.S. patent application Ser. No. 12/173,902 filed Jul. 16, 2008, entitled PERFORATED FLAME TUBE FOR A LIQUID FUEL BURNER, the contents of which are incorporated by reference in its entirety.

BACKGROUND OF THE INVENTION

1. Field of the Invention

The field of the present invention is liquid fuel burners which ignite and burn atomized liquid fuel within a flame tube.

2. Background

Several different types of liquid fuel burners are well known in the art, with each type having arguable advantages over the other types. One type of liquid fuel burner is generally described in U.S. Pat. No. 4,298,338, the disclosure of which is incorporated herein by reference in its entirety. While various aspects of this type of liquid fuel burner have undergone improvements over the last 25 years, e.g., improvements to the atomizer are disclosed in U.S. Pat. No. 4,507,076 and U.S. Pat. No. 4,573,904, the disclosures of which are incorporated by reference in their entirety, one persistent issue is scorching of the discharge end of the flame tube. Ultimately, over an extended period of use, such scorching may result in damage to the flame tube, requiring replacement of the flame tube. Of course, if the liquid fuel burner is used in an area where spare parts are readily available, replacement of the flame tube will not normally present a significant inconvenience. But, when the liquid fuel burner is used in the field and spare parts are hard to come by, a damaged flame tube can remove the burner from operation if no spares are available. The present invention, therefore seeks to reduce or eliminate scorch damage at the discharge end of the flame tube.

SUMMARY OF THE INVENTION

The present invention is directed toward a flame tube for a liquid fuel burner. The liquid fuel burner includes a fuel atomizer adapted to direct atomized fuel into the flame tube and an igniter disposed within the flame tube to ignite the atomized fuel. The flame tube includes an inner wall and an outer wall, with an air passage defined between the two walls. At the discharge end of the flame tube, the inner and outer walls are conjoined to form a perforated annular surface. Preferably, the annular surface is perforated in an evenly distributed pattern.

Accordingly, an improved flame tube for a liquid fuel burner is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
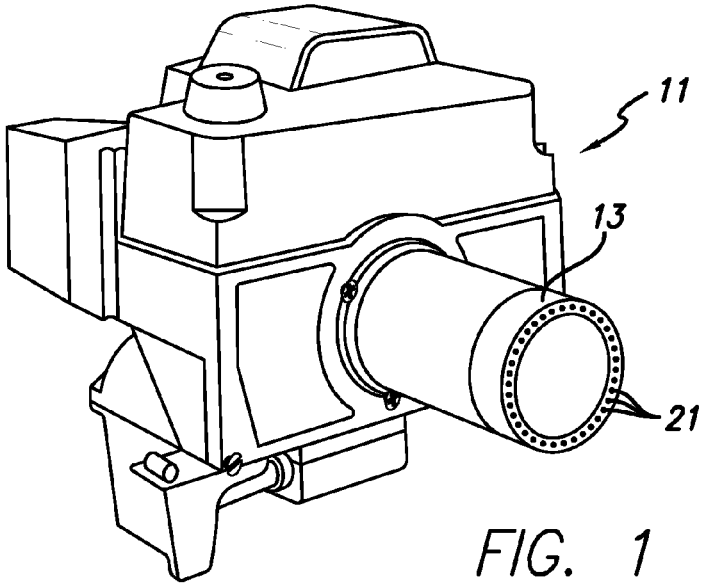
FIG. 1 illustrates a perspective view of a liquid fuel burner.
Figure 2:
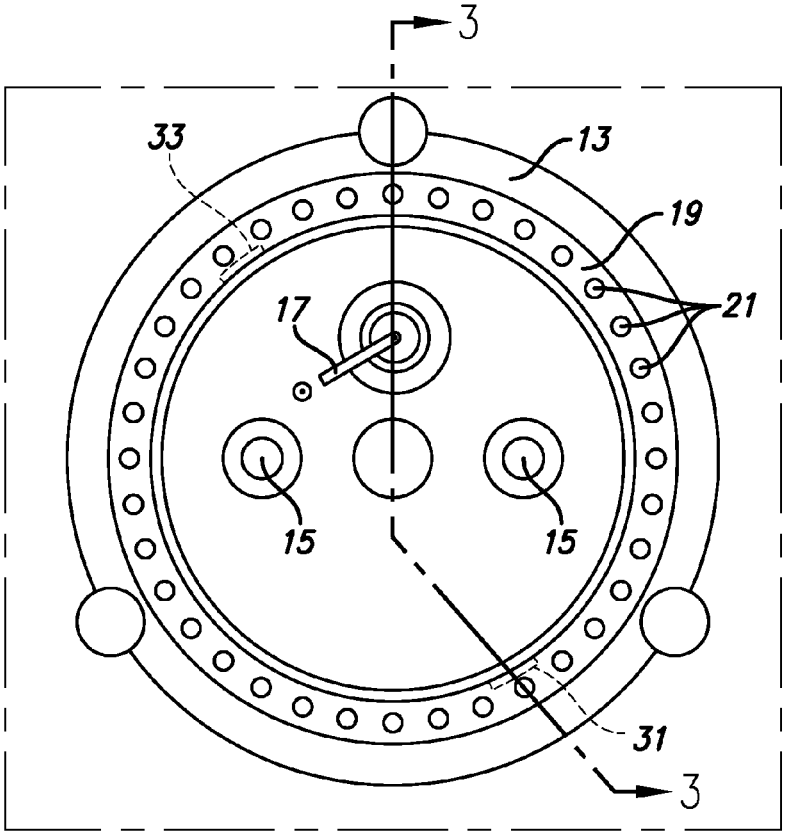
FIG. 2 illustrates a side plan view of a perforated flame tube.

Turning in detail to the drawings, FIG. 1 illustrates a liquid fuel burner 11 with an attached flame tube 13. The liquid fuel burner is of the type long sold by Babington Technology of McLean, Va. The general principles of operation of such liquid fuel burners are therefore well understood by those of skill in the art. FIG. 2 is a view looking into the discharge end of the flame tube 13. Liquid fuel atomizers 15 are positioned to direct atomized fuel into the flame tube 13, and a spark igniter 17 is appropriately positioned within the flame tube to ignite the atomized fuel. The annular surface 19 formed at the discharge end of the flame tube 13 includes a plurality of perforations 21. As shown, the perforations 21 form an evenly distributed pattern on the annular surface 19. The positioning and distribution of the perforations, however, are a matter of design choice. The distribution of the perforations 21 allows cooling air to evenly pass through the discharge end of the flame tube 13. This cooling air reduces the temperature at the discharge end of the flame tube, thereby preventing metallurgical deterioration, flame erosion, and scorching of the discharge end of the flame tube. As a practical matter, the cooling air limits expansion of the emerging flame in the radial direction of the flame tube 13, while having little, if any, impact on extension of the emerging flame in the longitudinal direction of the flame tube. In reducing expansion of the emerging flame, scorch damage to the discharge end of the flame tube 13 may be significantly reduced.

Figure 3:
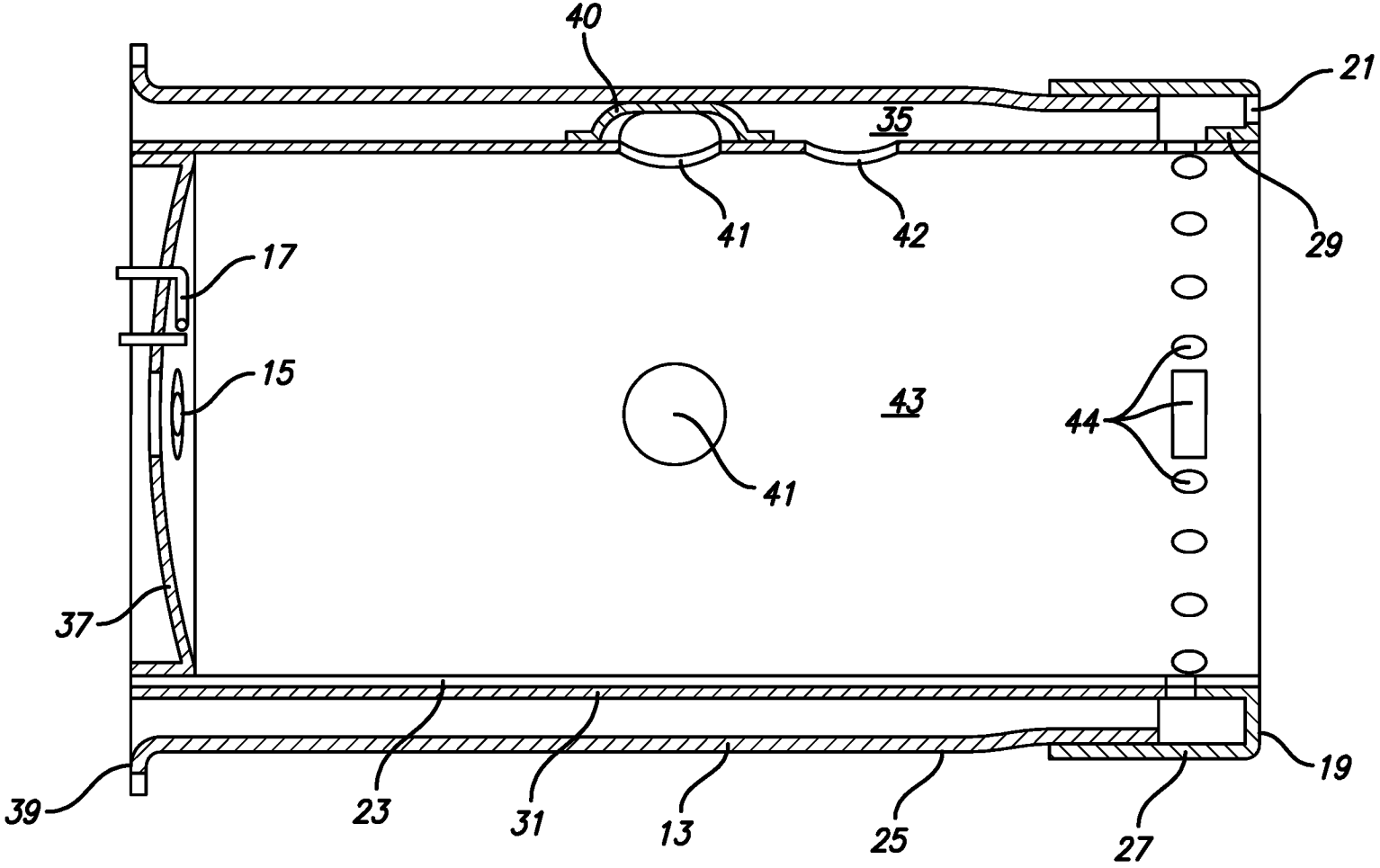
FIG. 3 illustrates a sectional view of a perforated flame tube.

Construction of the flame tube 13 is shown in greater detail in FIG. 3. The flame tube 13 is formed as a double walled cylinder having an inner wall 23, an outer wall 25, and a cap 27. The cap 27 is affixed to the outer wall 25 via spot welds and includes an inward curling lip 29 which forms the annular surface 19 at the discharge end of the flame tube 13. The inner wall 23 has a slip-fit with the lip 29, although more permanent connections between the two parts may be used. The inner wall 23 is formed out of a single sheet of steel, wrapped into a cylinder, and held together with a steel strip 31 spot welded across the seam. A second steel strip 33 is welded to the opposite side of the cylinder, and neither steel strip 31, 33 fully extends the full length of the inner wall 23. At the discharge end of the flame tube 13, the inner wall 23 is slip fit into the lip 29 such that the steel strips 31, 33 abut against the lip 29 and help maintain the desired relative positioning between the inner wall 23 and the outer wall 25. Constructed in this manner, an air passage 35 is formed between the inner wall 23 and the outer wall 25.

Opposite the discharge end, the inner wall 23 slides over an enclosure 37 which houses the liquid fuel atomizers 15 and the spark igniter 17. The outer wall 25 includes a flange 39 which is used to affix the flame tube 13 to the body of the liquid fuel burner 11. One or more forced air ports (not shown) are positioned on the body of the liquid fuel burner 11 to direct air from an air blower into the air passage 35.

Like the Babington liquid fuel burners known in the prior art, forced air is directed into the air passage 35. The inner wall 23 includes a plurality of primary apertures 41 covered by directional louvers 40, a plurality of secondary apertures 42, and a plurality of tertiary apertures 44, all of which allow air to enter into the combustion chamber 43 during operation to aid in the complete combustion of the atomized fuel within the combustion chamber 43. The primary apertures 41 and associated louvers 40 introduce swirling air to aid in preventing atomized fuel from adhering to the wall of the combustion chamber 43, while the secondary apertures 42 substantially eliminate the aid in achieving swirling and turbulence. The tertiary apertures 44 introduce a last amount of air to complete combustion while also shaping the flame emerging from the discharge end of the flame tube 13. Air introduced into the air passage 35 is heated by the ongoing combustion process such that the heated air introduced into the combustion chamber 43 is more suitable for use in maintaining ongoing combustion. While this air is heated, its temperature is still less than the resulting products of combustion emerging from the combustion chamber 43. Thus, the air passing through the perforations 21 at the discharge end of the flame tube 13 is cooler and aids in protecting the discharge end of the flame tube from scorching in the manner described above.

Thus, a flame tube for a liquid fuel burner is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A flame tube for a liquid fuel burner having a fuel dispenser and a flame output, the flame tube comprising:

a circular inner wall at least partially defining a combustion chamber extending generally from the fuel dispenser to the exit; and a plurality of apertures in the inner wall, comprising:

a first set of apertures configured to introduce swirling air into the combustion chamber;

a second set of apertures configured to introduce air into the combustion chamber in a radially inward direction that disrupts swirling induced by the first set of apertures;

a third set of apertures configured to introduce a last amount of air into the combustion chamber to substantially complete combustion of the fuel within the combustion chamber and to shape any residual flame that emerges from the combustion chamber;

an exit wall defining a discharge end of the combustion chamber; and a fourth set of apertures in the exit wall configured to introduce air outside of the combustion chamber that limits expansion of any residual flame in a radial direction of the flame tube, thereby cooling the discharge end and preventing scoring of the discharge end by directing any residual flame and/or heat from combustion process away from the discharge end;

wherein substantially all of the ignited fuel is combusted before exiting the combustion chamber.

2. The flame tube of claim 1, further comprising:

an outer wall surrounding the circular inner wall, and defining a gap there between; and the gap serving as the source of air for the first, second and third apertures.

3. The flame tube of claim 2, further comprising:

the exit wall being connected to the outer wall.

4. The flame tube of claim 3, wherein the inner wall is connected to the outer wall.

5. The flame tube of claim 1, further comprising flanges in the combustion chamber over the first set of apertures configured to direct airflow in a swirling pattern.

6. The flame tube of claim 1, wherein the second and third sets of apertures have different dispersal patterns on the inner wall.

7. The flame tube of claim 1, wherein the third set of apertures are disposed radially and equidistantly around the inner wall.

8. The flame tube of claim 1, wherein the first, second and third set of apertures are arranged in sequence from the first end to the second end of the combustion chamber.

9. The flame tube of claim 1, further comprising an end cap having the exit wall, the end cap being mounted on at least the inner wall of the combustion chamber.

10. The flame tube of claim 9, wherein the end cap connects to the inner wall via a slip fit or a permanent connection.

11. The flame tube of claim 2, further comprising an end cap, the end cap having the exit wall, the end cap being mounted on the inner wall and outer walls of the combustion chamber.

12. The flame tube of claim 11, wherein the end cap connects to the inner wall via a slip fit or a permanent connection.

13. The flame tube of claim 11, wherein the end cap connects to the outer wall via a permanent connection.

* * * * *